US005979425A

United States Patent [19]

Loomis

[11] Patent Number: 5,979,425

[45] Date of Patent: Nov. 9, 1999

[54] ADJUSTABLE COMPOUND BOW

[76] Inventor: L. Rodger Loomis, 1263 County Rte. 54, Fulton, N.Y. 13069

[21] Appl. No.: 09/228,841

[22] Filed: Jan. 12, 1999

[51] Int. Cl.[6] ..... F41B 5/10

[52] U.S. Cl. ..... 124/25.6

[58] Field of Search ..... 124/23.1, 24.1, 124/25.6

[56] References Cited

U.S. PATENT DOCUMENTS

| | | | |
|---|---|---|---|
| 3,981,290 | 9/1976 | Islas | 124/25.6 |
| 4,287,867 | 9/1981 | Islas | 124/25.6 |
| 4,781,168 | 11/1988 | Lester | 124/25.6 |
| 4,858,588 | 8/1989 | Bozek | 124/25.6 X |
| 5,205,267 | 4/1993 | Burdick | 124/24.1 |
| 5,388,564 | 2/1995 | Islas | 124/25.6 |
| 5,499,618 | 3/1996 | Thompson | 124/25.6 |
| 5,687,703 | 11/1997 | Vyprachticky | 124/25.6 |

OTHER PUBLICATIONS

Browning Bows Advertisement, 1998 Browning Bows (Stocked Items), 1998 Catalog p. 81.

*Primary Examiner*—John A. Ricci

*Attorney, Agent, or Firm*—Wall Marjama Bilinski & Burr

[57] ABSTRACT

A compound archery bow includes a pair of power limbs, each extending from a reflexed end of a riser portion. Outer bow limbs having a flexibility greater than the power limbs are hingably attached via a hinge assembly to the end of each power limb. A power/reflex cable interconnects each side of the riser and extends through spaced openings provided in the outer bow limb on either side of the hinge assembly such that the outer bow limbs are caused to bend when a bowstring is pulled. The power/reflex cable preferably extends through openings provided on either side of each outer bow limb relative to the hinge assembly to allow the pull weight to be reduced prior to the maximum draw of the bowstring and to provide synchronization of the power limbs upon draw and release of the bowstring. Adjustable weight bolt connecting the power limbs to the riser may be adjusted to increase or decrease the pull weight of the bow. Likewise, the length of the bowstring may be adjusted by twisting or otherwise to adjust the pull weight of the bow.

6 Claims, 2 Drawing Sheets

ADJUSTABLE COMPOUND BOW

FIELD OF THE INVENTION

This invention relates to an improved compound archery bow which is adjustable to allow for a lighter draw weight for different classes of users, including children.

BACKGROUND OF THE INVENTION

A number of compound archery bows are known which include programming means that are incorporated to regulate the draw weight of the bow such that a maximum pull weight is attained at an intermediate draw position and a reduced weight is attained at full draw.

A number of these bows, such as sold by Bear/Jennings, include cam assemblies, each having a plurality of intermediate cams in order to interconnect and synchronize the bow limbs. These bows, due to their overall complexity, require precision in assembly and manufacture and are costly.

In another known design, described in U.S. Pat. No. 5,388,564 to Islas, a compound archery bow includes a bow riser having spring power limbs cantilevered at each end. Cam pulleys are mounted on the outboard ends of each power limb and rigid limb members are affixed to the cam pulleys. The bowstring extends between the extending ends of the two rigid limb members. Endless power and reflex cables are run from the end of the riser, each cable extending along a path which passes over a cam groove of each cam pulley. An end of the cable is reeved in the cam pulley. A link member is coupled at one end to an outer point fixed with respect to the cam pulley and outer limb, and is coupled at its other end to a synchronizing pulley or wheel.

When the bowstring is drawn, the outboard ends of the outer bow limbs are pulled inwardly causing the cam pulleys to rotate due to the presence of an existing power cable. The cam pulleys wind the cable and rotate the synchronizing wheel. A rigid bar extending from the synchronizing wheel pulls the reflex cable downward and pulls the cam pulleys downwards towards the riser, in order to flex the power limbs. The power limbs then supply the energy for the flight of the arrow, and pulls the rigid limbs back to the upright position when the bowstring is released.

All current compound bows utilize some form of cam assembly to coordinate the interaction between the power limbs and the outer limbs.

Although each type of design is useful for powering arrows for flight, a need exists for a compound bow with fewer parts, lighter weight and excellent draw characteristics. Each of the above bow designs also require a considerable pull weight for use. Neither are suitable for children who do not have sufficient strength for their use. There is a further need for a bow suitable for children who want to attempt archery but are unable to do so because of size and draw weight considerations. Current art for short length draw bows for children and youth do not provide sufficient kinetic energy to satisfy the need for target penetration of flat trajectory.

SUMMARY OF THE INVENTION

It is an object of the present invention to improve the state of the art of archery bows.

It is a further object of the present invention to provide a compound archery bow that functions with a reduced number of parts, and with improved draw weight-to-displacement characteristics.

It is yet a further object of the present invention to provide a compound archery bow which is suitable for use for children or other classes of users which have considerable difficulty in handling and efficiently using currently known bows.

It is still a further object of the present invention to provide a compound bow which can be adjusted in a simple and reliable manner without significant modification.

It is yet another object of the present invention to provide a short draw length bow having the power necessary to achieve target penetration while being easily used by children and youth.

Therefore, and according to a preferred aspect of the invention, there is described a compound archery bow comprising a riser portion having respective upper and lower ends. A power limb is attached to each respective end of the riser portion and a pair of outer bow limbs are hingedly attached to each power limb via hinging means. Power and reflex cabling, which is flexible yet inextensible, is guided through and around spaced openings which are provided in the outer bow limbs and spaced on either side of the hinging means. In addition, the placement of the power/reflex cabling also serves to synchronize the bow.

A feature of the invention is that the bow can be adjusted so as to be handled by different classes of users. An adjustable weight bolt, used to attach the power limbs to the riser portion, can be adjusted to selectively allow either a lighter or heavier pull weight. An advantage of this feature is that young users can utilize the bow. Another feature of the presently described bow is that young users can continue to use the same bow as they grow by adjusting the weight bolt in a suitable manner.

Another significant feature of the described bow is that the length of the draw of the bowstring is also adjustable. Adjusting the draw length accomplishes two functions. First, a shorter drawlength means the bowstring can come to the fully drawn position with less pulling action required on the part of the user. Second, a shorter draw length means that a lesser peak draw weight will be required.

Yet another feature of the present invention is that the power/reflex cabling also serves to synchronize the bow, thereby allowing the design to be made with fewer parts and without tedious manufacturing precision required in known compound bows.

The above and many objects, features and advantages of this invention will become readily apparent to those skilled in the art from the ensuing Description of the Invention which should be read in conjunction with the accompanying Drawings.

DETAILED DESCRIPTION OF THE INVENTION

Figure 1:
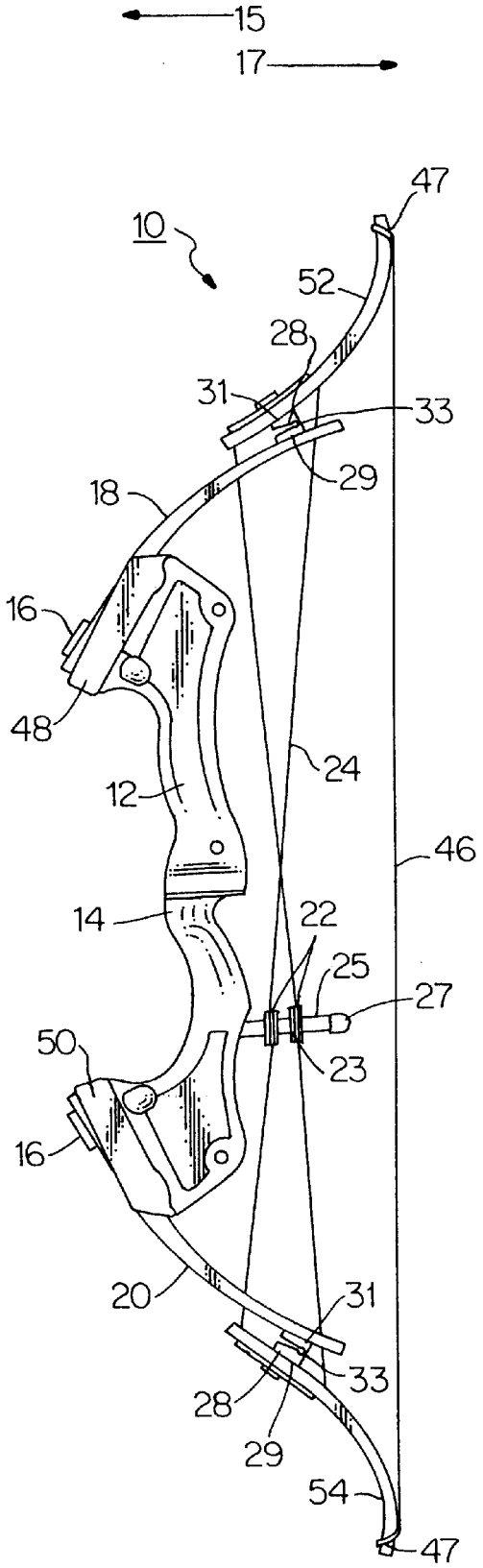
FIG. 1 is a side elevational view of a compound bow according to a preferred embodiment of this invention.
Figure 2:
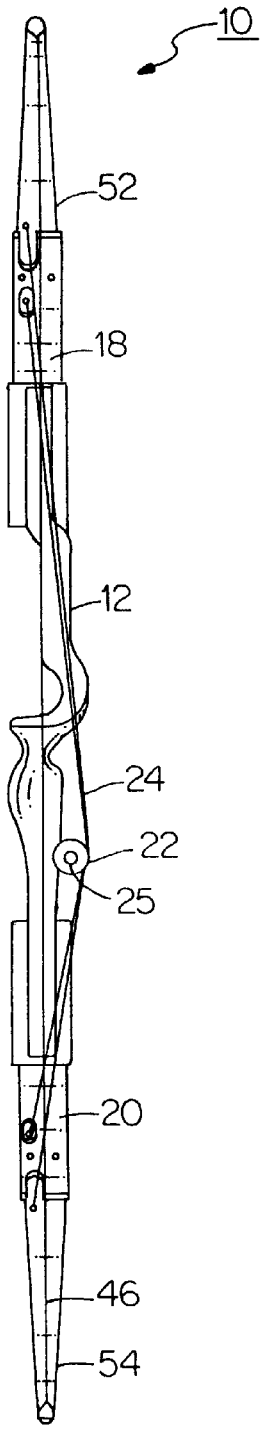
FIG. 2 is an elevational view taken from the belly side of the compound bow of FIG. 1.
Figure 3:
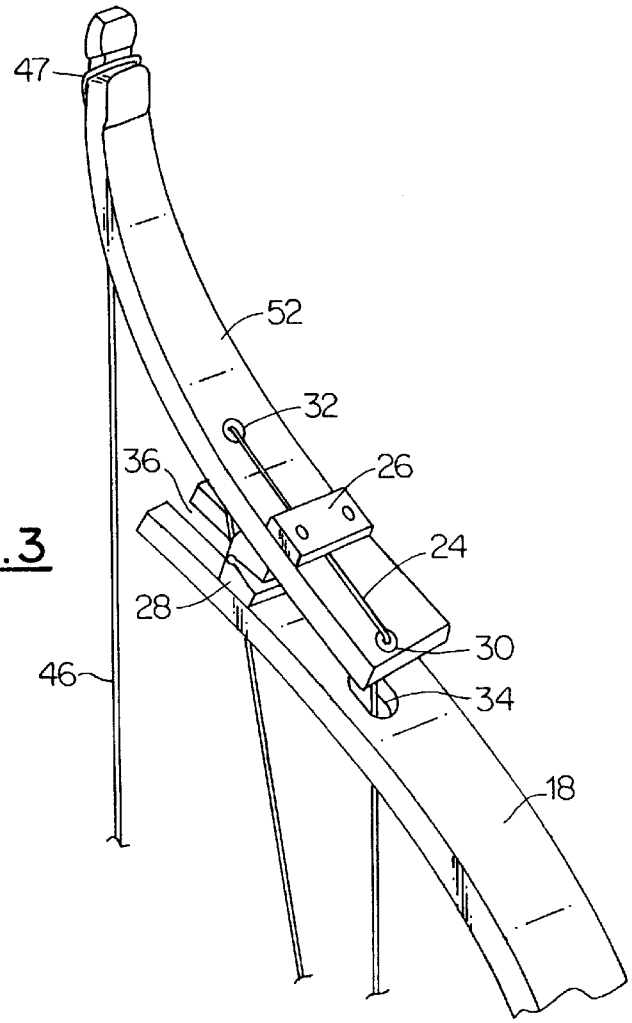
FIG. 3 is a partial top perspective view of the compound bow of FIGS. 1 and 2 showing the interconnection of the power and outer bow limbs.

With reference to the drawings, FIG. 1 shows a preferred embodiment of the compound archery bow 10 of the present invention in its conventional upright orientation. A riser portion 12 includes a center hand-grip portion 14, as well as a pair of opposite ends, referred to herein as upper and lower ends, 48, 50, respectively. The riser portion 12 is preferably fabricated from a strong, lightweight material, such as aluminum, though other suitable materials, for example—composite fibers or die cast magnesium can be utilized. For purposes of the description which follows, and as is commonly known to those versed in the field, the side of the bow 10 facing the target is referred to as the facing side 15, and the opposing side of the bow facing the archer is referred to as the belly side 17.

The inboard ends of a pair of fairly inflexible power limbs 18, 20 are attached to the upper and lower ends 48, 50 of the riser portion 12, respectively. More specifically, the power limbs 18, 20 are cantilevered from each end of the riser portion 12 with the inboard ends being disposed in corresponding pockets (not shown) using adjustable weight bolts 16. Preferably, the power limbs 18, 20 are fabricated from a composite material of good elasticity and a high spring constant, such as fiber glass.

As noted, the weight bolts 16 are adjustable so as to allow the draw weight of the bow 10 to be adjusted as described in detail below. For example, by tightening the weight bolt 16 in a clockwise fashion, the draw weight is increased. Similarly, by turning the weight bolt 16 counterclockwise, the draw weight of the bow 10 can be decreased. The compound bow, according to this embodiment, has a draw weight range of less than 25 pounds pull, with a draw weight range of between 10 to 20 pounds pull being optimal. Other suitable ranges can be selected, for example, a compound bow (not shown) having a draw weight range of 20–50 pounds pull can be manufactured by using a stronger riser portion.

A pair of corresponding outer bow limbs 52, 54 are hingably attached to the outboard ends of each power limb 18, 20, respectively, using a hinge assembly 28. The hinge assembly 28 includes a lower hinge plate 29 mounted to the exterior facing side of each power limb 18, 20 adjacent the outboard end and an upper hinge plate 31 mounted to the interior side of each outer bow limb 52, 54 at an intermediate point of each outer limb's length. A hinge joint 33 interconnects the hinge plates which are fixedly mounted and allow relative movement about the hinge joint. Additional details of the hinge assembly 28 are described in greater detail in copending and commonly owned patent application U.S. Ser. No. 09/085,436, the contents of which are herein incorporated by reference.

Respective ends of a bowstring 46 are attached to nocks 47 provided on the articulated ends of each of the outer bow limbs 52, 54. According to the present embodiment, the bow 10 is typically set at a twenty inch draw.

Referring to FIGS. 1–4, a pair of cable access openings 30, 32 are provided in each of the outer bow limbs 52, 54. The openings 30, 32 of each pair are oppositely disposed relative to the hinge assembly 28 and each pair of openings are axially aligned in relation to each other; that is, between the upper and lower end of the bow 10. In addition, each power limb 18, 20 also includes a pair of corresponding openings or slots 34, 36 that are aligned with the cable access openings 30, 32 in the outer bow limbs 52, 54 for allowing the passage of a power/reflex cable 24.

As noted, an endless power/reflex cable 24 is routed through each of the openings 30, 32, 34, 36 provided in the outer bow limbs 52, 54 and power limbs 18, 20, respectively. For purposes of explanation, the path of the cable 24 begins from the exterior side of one of the outer bow limbs 52 and extends through an access opening 30 through the aligned opening 34 provided in the power limb 18 and extends through the oppositely disposed openings 36, 32 of the power limb 20 and outer bow limb 54, respectively on the other end of the bow 10. The cable 24 is then being routed over the exterior side of the outer bow limb 54 through the openings 30, 34 of the outer bow limb 54 and interconnected power limb 20 and to the opposite openings 36, 32 of the power limb 18 and outer bow limb 52, with the cable crossing itself in substantially a figure eight configuration to complete the loop.

The riser portion 12 includes a fixedly attached or integral extending member, hereinafter referred to as a cable guard 25, which extends toward the belly side 17 of the bow 10; that is, toward the archer, and is aligned with the reflexed power limbs 18, 20. The extending member 25 is typically located below the hand grip portion 14 in the vicinity of the center of the bow, though other suitable locations could be utilized. A pair of idler wheels 22 having exterior peripheral grooves 23 are provided, each wheel preferably being freely movable along the axial length of the extending member 25 to a stop 27. The path of the two extending portions of the power/reflex cable 24 preferably extends over the peripheral grooves 23 of a corresponding idler wheel 22, which are deliberately offset relative to the axis of the riser portion 12 defined by the bowstring 46, to prevent interference with an arrow (not shown) positioned on the center portion 14. Alternately, the idler wheel can be replaced, for example with cable slides (not shown).

The power/reflex cable 24 is secured on the exterior side of each of the outer limbs 52, 54, via a clamping plate 26 disposed between the openings 30, 32. Alternately, a pair of cables can be substituted in lieu of the single power/reflex cable with ends thereof being secured beneath the clamping plates 26. The clamping plates 26 also assist in maintaining a constant length between the openings 30, 32 of the outer bow limbs 52, 54. For example, whether in the fully drawn position of FIG. 4 or the undrawn position of FIG. 1, the distance between the openings 30, 32 will remain constant.

The idler wheels 22 move upon movement of the bowstring 46, thus providing equal tension on the extending portions of the power/reflex cable 24. The idler wheels 22, clamping plates 26 and adjustable weight bolts 16 combine to ensure that there is synchronization without twisting of the outer bow limbs 52 and 54 and the power limbs 18 and 20.

Figure 4:
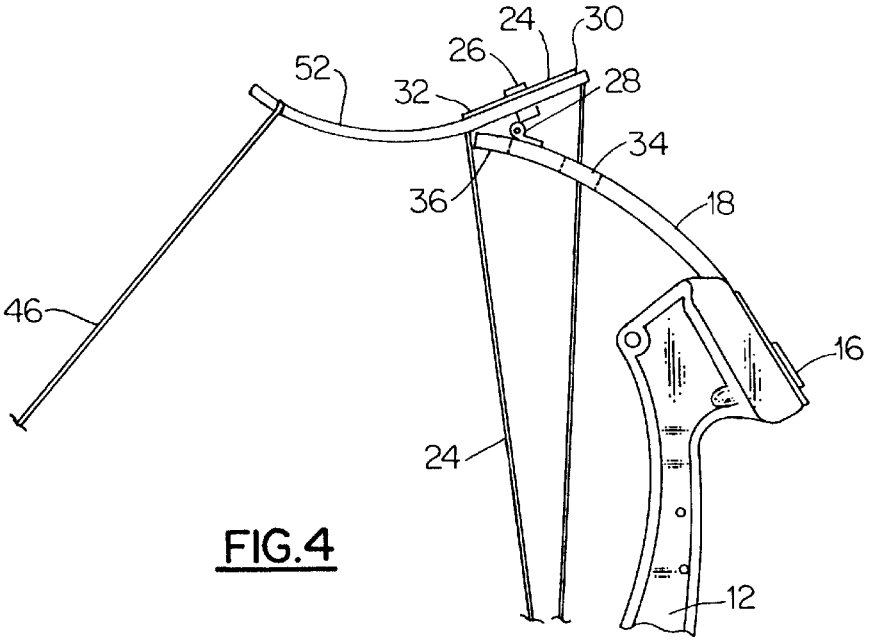
FIG. 4 is a partial side elevational view of the bow of FIGS. 1–3, showing the relative positions of the upper outer limb and upper power limb when the bowstring is in the fully drawn position.

In use and when the bowstring 46 is drawn, the outer bow limbs 52, 54 are pulled inwardly and are caused to rotate to the position shown in FIG. 4 (only one side of the bow being shown). The above action opens the hinge assemblies 28, thereby flexing each power limb 18, 20. The idler wheels 22 also move axially and radially, as an ancillary effect, along the length of the extending member 25. Due to the hinging action, the maximum draw force is achieved prior to the maximum extension of the bowstring 46 due to the interconnection of the power/reflex cable 24.

When the bowstring 46 is released, the power limbs 18, 20 supply the energy for the flight of the arrow, and pull outer bow limbs 52, 54 back to their original positions in conjunction with the power/reflex cable 24.

The shape, size and positions of the power limbs 18, 20, outer bow limbs 52, 54 and hinge assembly 28 all combine to determine the draw weight characteristic of the compound bow and can be suitably varied.

The adjustable weight bolts 16 of the presently described bow 10 perform an additional function to tiller or time the bow. This function can be achieved by measuring the gap under the weight bolt 16, between the power limb and the pocket (not shown) in the end of the riser portion 12 where the power limb and riser meet. Preferably each bow end should be within approximately 1/16 inch of each other, although minor deviations in tiller do not pose significant problems in use of the bow 10.

In order to shorten the draw, the bow is vertically positioned relative to a floor, table or other horizontal surface and one end of the bow 10; for example end 48, is pushed downwardly, causing flexion of the outer bow limb 52 and removal of the tension on the bowstring. The end of the bowstring 46 can then be taken off the nock 47 of the outer limb 52 and twisted a predetermined number of turns to shorten the bowstring. According to the present example, ten (10) turns is sufficient, before placing the bowstring back into the nock 47. If the bowstring 46 is still too long after a number of turns, then it is allowable to place a shorter bowstring onto the bow 10. A shorter bowstring (not shown) decreases the peak draw weight.

While the above design requires no wheels or eccentrics to achieve let off, it is necessary to stop the over rotation of the outer limbs. In this preferred embodiment, the limb rotation is stopped at a point to achieve 50% reduction (letoff) in holding weight by machining the power limbs 18 to a predetermined length to achieve desired rotation, but still limiting over rotation. Alternately, a bracket (not shown) could be attached to the power limb 18 or outer limb 52 to adjust so that rotation is stopped at varying points.

PARTS LIST FOR FIGS. 1–4

10 compound bow
12 riser portion
14 center hand-grip portion
15 facing side
16 adjustable weight bolts
17 belly side
18,20 power limb
22 idler wheels
23 peripheral grooves
24 power/reflex cable
25 extending member
26 clamping plates
27 stop
28 hinge assembly
29 upper hinge plate
30 inboard opening—outer bow limb
31 lower hinge plate
32 outboard opening—outer bow limb
33 hinge
34 inboard opening—power limb
36 outboard opening—power limb
46 bowstring
47 string nocks
48 upper end
50 lower end
52,54 outer bow limb While the compound bow of this invention has been described with reference to a selected preferred embodiment, it should be recognized that the invention is not strictly limited to those embodiments. Rather many modifications and variations are possible without departure from the scope and spirit of this invention, as defined in the appended claims.

I claim:

1. A compound archery bow comprising:

a riser portion having an upper end and a lower end;

upper and lower power limbs each having an inboard end respectively attached to said upper and lower ends of said riser portion;

upper and lower outer bow limbs each having an inboard end hingably attached to outboard ends of said upper and lower power limbs;

hinging means interconnecting said power limbs and said outer bow limbs wherein each of said upper and lower outer bow limbs include a pair of through openings oppositely disposed relative to said hinging means;

a bowstring having two ends, wherein said ends are connected to outboard ends of said upper and lower outer bow limbs; and at least one cable extending along a defined cable path extending through between said outer bow limbs through openings provided on either side of said hinging means, said path extending between said upper and lower outer bow limbs along a first segment extending from an inboard opening of one of said outer bow limbs to the outboard opening of said opposite outer bow limb and a second segment extending between an inboard opening of the other of said outer bow limbs and the outboard opening of the opposite outer bow limb to produce power and reflex functions when said bowstring is pulled and released.

2. The archery bow of claim 1, including clamping means for clamping said at least one cable to the exterior side of each of said upper and lower outer bow limbs.

3. The archery bow of claim 1, further including a pair of idler wheels, each idler wheel having a peripheral groove for retaining said power/reflex cable.

4. The archery bow of claim 1, further including weight bolts for attaching said upper and lower power limbs to said respective ends of said riser.

5. The archery bow of claim 4, wherein said weight bolts are adjustable for selectively varying the pull weight of said bow.

6. The archery bow of claim 1, wherein each of said power limbs include openings allowing the passage of said at least one cable therethrough.

* * * * *